US007015820B2

(12) United States Patent
Bobenhausen

(10) Patent No.: US 7,015,820 B2
(45) Date of Patent: Mar. 21, 2006

(54) APPARATUS FOR MONITORING A SMOKE DETECTOR

(75) Inventor: Axel Bobenhausen, Bremen (DE)

(73) Assignee: Airbus Deutschland GmbH, Hamburg (DE)

( * ) Notice: Subject to any disclaimer, the term of this patent is extended or adjusted under 35 U.S.C. 154(b) by 67 days.

(21) Appl. No.: 10/838,640

(22) Filed: May 3, 2004

(65) Prior Publication Data

US 2004/0246137 A1 Dec. 9, 2004

(30) Foreign Application Priority Data

May 2, 2003 (DE) ..... 103 19 688

(51) Int. Cl.
*G08B 17/10* (2006.01)

(52) U.S. Cl. ..... 340/628; 340/607; 340/626

(58) Field of Classification Search ..... 340/628, 340/607

See application file for complete search history.

(56) References Cited

U.S. PATENT DOCUMENTS

| | | | | |
|---|---|---|---|---|
| 4,914,425 | A * | 4/1990 | Kaminaka et al. | 340/693.6 |
| 5,182,542 | A * | 1/1993 | Adelman et al. | 340/521 |
| 5,351,035 | A * | 9/1994 | Chrisco | 340/607 |
| 5,399,864 | A * | 3/1995 | Igarashi et al. | 250/381 |

* cited by examiner

*Primary Examiner*—Jeffery Hofsass
*Assistant Examiner*—George Bugg
(74) *Attorney, Agent, or Firm*—W. F. Fasse; W. G. Fasse

(57) ABSTRACT

The proper function of a smoke detector of an enclosed space, such as a toilet or freight space or crew quarters in an aircraft, is monitored by at least two air pressure sensors which are so positioned that these air pressure sensors can measure an air pressure differential in the air flow into the smoke detector. If a pressure differential is detected the differential is evaluated in a central processing unit which produces a respective signal that indicates that the air flow and thus the smoke flow into the smoke detector is obstructed, whereby the smoke detector cannot function properly. This signal is visibly or audibly indicated.

15 Claims, 1 Drawing Sheet

APPARATUS FOR MONITORING A SMOKE DETECTOR

PRIORITY CLAIM

This application is based on and claims the priority under 35 U.S.C. §119 of German Patent Application 103 19 688.9, filed on May 2, 2003, the entire disclosure of which is incorporated herein by reference.

FIELD OF THE INVENTION

The invention relates to an apparatus for monitoring a smoke detector and visually displaying and/or audibly announcing detected information in an aircraft.

BACKGROUND INFORMATION

Smoke detectors which are installed, for example in an aircraft toilet or in a freight space or in crew rest areas, must be monitored and checked frequently to assure their proper function when it becomes necessary to detect smoke. Particularly, it is necessary to monitor an air flow passage that leads to an air inlet of a smoke detector so that smoke can reach the detector. The air flow passage leading to the smoke detector inlet must not be clogged or otherwise obstructed by being covered, pasted up or otherwise contaminated so that air and thus smoke can reach the inlet opening of the smoke detector. The smoke detector cannot work if the smoke cannot get to the smoke detector. This clogging may, for example, occur in a protective screen or grid structure that is positioned in the air flow passage to the detector, whereby the function of the smoke detector would be impaired or even prevented.

It is necessary in all aircraft which by law must be equipped with smoke detecting devices, to regularly visually inspect these devices, for example in accessible areas such as toilets, crew rest areas or the like. These regular inspections must be made by the crew and must be done frequently, for example every 15 minutes, particularly on long distance flights. The check must make sure that the air flow passage or passages leading to the smoke detector are not obstructed. Thus, it is conventional to ascertain by an exclusively visual inspection whether the smoke detectors in the aircraft are prevented from functioning properly, for example by obstructions that may be a freight container that has been positioned in front of the air inlet and thus of the smoke inlet leading to the smoke detector. In areas in which unfiltered air is circulating such as in a freight space, the air flow passage leading to a smoke detector may be obstructed or even completely blocked quite quickly, which leads to impairing or even preventing the proper function of the smoke detector.

OBJECTS OF THE INVENTION

In view of the above, it is the aim of the invention to achieve the following objects singly or in combination:

- to facilitate a continuous monitoring of the smoke detectors in an aircraft;
- to provide a visual and/or audible indication in response to the fact that the proper functioning of a smoke detector is impaired or prevented; and
- to make sure that any kind of obstruction in the air flow passage of a smoke detector is instantly discovered, for example if attempts are being made in an aircraft toilet to obstruct the smoke detector in order to prevent the discovery of cigarette smoke in the toilet.

SUMMARY OF THE INVENTION

The above objects have been achieved according to the invention by arranging at least two air pressure sensors in the vicinity of each smoke detector. These air pressure sensors are so positioned within an air flow or smoke flow passage leading to an inlet of the smoke detector that a pressure differential caused by an obstruction of the air flow passage results in the detection of an obstruction within the air flow passage. The output signals of the air pressure sensors are supplied to an evaluation unit that may, for example be the central processing unit of the aircraft, which in turn provides a display signal that may be displayed on a television screen and/or it may be made audible, thereby signifying that the function of the smoke detector is impaired or event prevented by obstructions or clogging in the air flow passage leading to an air inlet of the smoke detector.

According to the invention it is an advantage that the smoke detector or detectors in an aircraft are monitored on a continuous or permanent basis by making sure that any smoke that is generated can freely pass to the respective smoke detector inlet without any flow reduction and without any flow prevention. Another important advantage of the invention is seen in that a wrong measurement of a pressure differential in the air flow passage can be prevented by timing the operation of the air pressure sensors, thereby preventing an erroneous reaction in case of pressure fluctuation of very short durations, for example when a vacuum toilet is activated. Furthermore, it is advantageous that a blockage or partial clogging of the air flow passage can be automatically reported to a location outside the enclosure in which the smoke detector is installed. Thus, the display or indication of the signal that signifies such a blockage or clogging may be made visible or audible anywhere within the aircraft, particularly outside the space in which the smoke detector is installed, such as a toilet or freight space. The respective signals may be transmitted to a monitor of a central maintenance system, whereby the monitor may be located, for example, in the cockpit of the aircraft.

BRIEF DESCRIPTION OF THE DRAWINGS

In order that the invention may be clearly understood, it will now be described in connection with example embodiments thereof, with reference to the accompanying drawings, wherein.

DETAILED DESCRIPTION OF A PREFERRED EXAMPLE EMBODIMENT AND OF THE BEST MODE OF THE INVENTION

Figure 1:
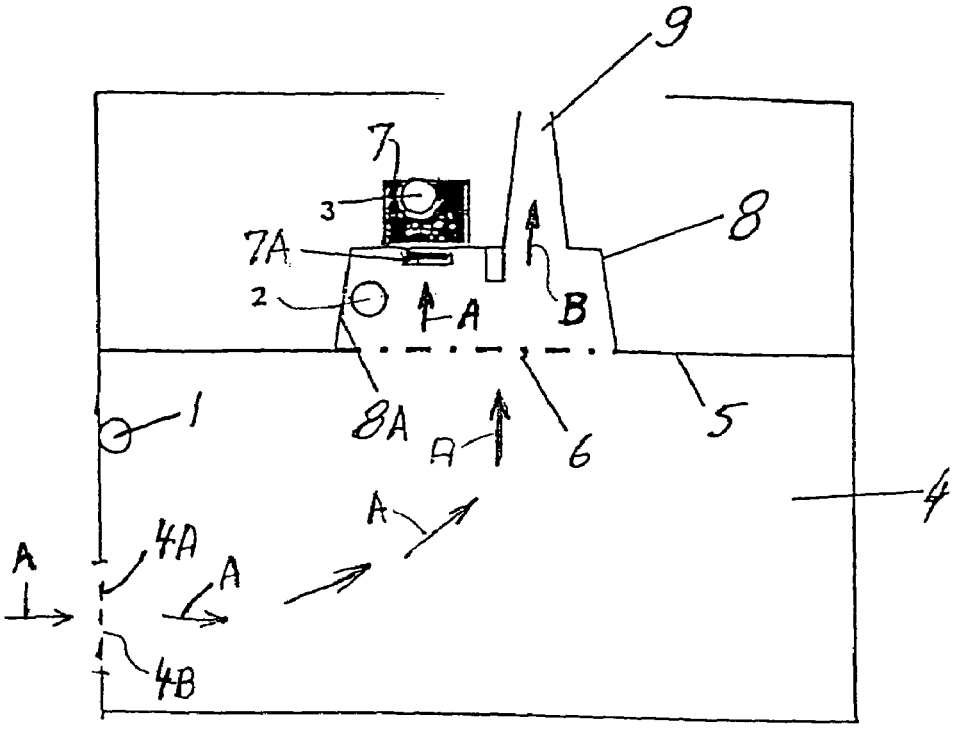
FIG. 1 shows schematically an aircraft toilet with a smoke detector that is monitored according to the invention by three air pressure sensors.

FIG. 1 shows schematically an aircraft toilet 4 having a door 4A in which an air inlet 4B is installed. Arrows A indicate an air flow passage which is also a smoke flow passage since the air flow transports any smoke generated in the toilet or within a smoke detector housing 8 to the smoke detector 7 installed above a toilet ceiling 5. A protective grid or screen structure 6 separates the smoke detector housing 8 from the toilet space below the ceiling 5. The smoke detector housing 8 forms a hood in which normally a fan is installed for generating the air flow A and an exhaust air flow B through a used air discharge channel 9 leading out of the smoke detector housing or hood 8.

In the example embodiment of FIG. 1, three air pressure sensors 1, 2 and 3 are installed in the vicinity of the smoke detector 7 whose air inlet 7A faces into the smoke detector housing 8. One air pressure sensor 1 is installed inside the toilet 4. Another air pressure sensor 2 is secured to the inner wall 8A of the smoke detector housing 8. Another air pressure sensor 3 is installed directly in the smoke detector 7.

According to the invention two smoke detectors cooperate in the discovery of a pressure differential that may have been caused by a clogging or obstruction of the grid or screen structure 6 and/or of the air or smoke inlet 7A of the smoke detector 7. More specifically, a pressure differential caused by an obstruction of the air inlet 7A of the smoke detector 7 is sensed by the two air pressure sensors 2 and 3. A pressure differential across the protective screen or grid structure 6 is discovered by the air pressure sensors 1 and 2. A clogging of the air inlet 7A can also be discovered by the air pressure sensors 1 and 3. In this case the sensed pressure differential would still correctly indicate that the smoke detector cannot function properly. However, it would not be clear whether the inlet 7A or the screen 6 is clogged.

Figure 3:
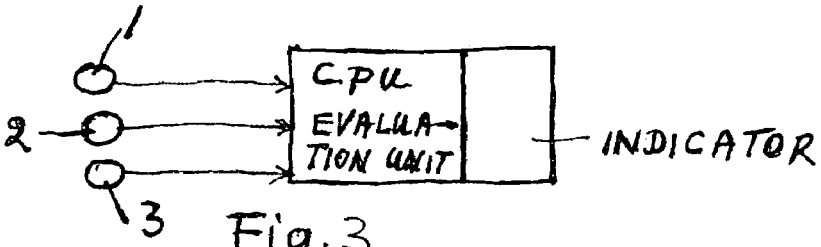
FIG. 3 shows schematically that the air pressure sensors are electrically connected to a central processing unit for evaluating the air pressure differential signals.

FIG. 3 shows that the output signals of the air pressure sensors 1, 2 and 3 are supplied to a central processing unit that functions in this instance as an evaluation unit of the air pressure differential signifying signals. The CPU generates an indication signal that is supplied to an indicator which may be a television screen and/or a loudspeaker which will provide an indication that either the screen 6 or the air inlet 7A of the smoke detector 7 have been partially or completely obstructed or clogged so that the smoke detector 7 cannot function properly. An obstruction of the screen or grid structure 6 can be discovered in two ways. First, the two air pressure sensors 1 and 2 cooperate in such discovery as mentioned above. Second, the air pressure sensors 1 and 3 can cooperate in discovering a pressure differential across the screen or grid structure 6 or across the air inlet 7A. In both instances where the impairment of the smoke detector function is discovered, it would merely not be clear whether 7A or 6 is clogged.

Figure 2:
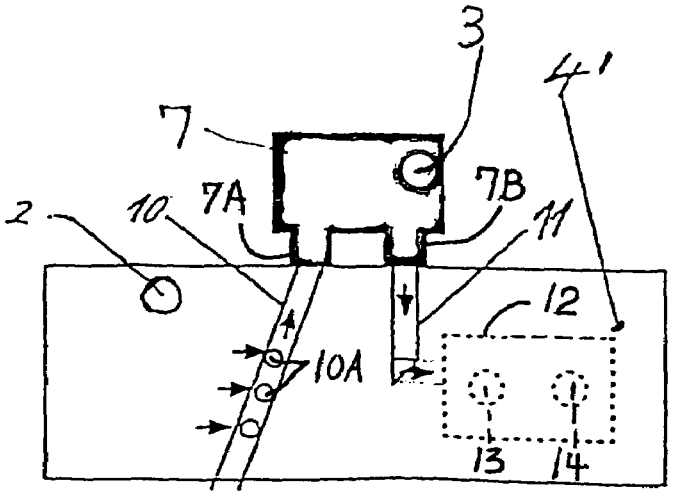
FIG. 2 shows an embodiment in which the smoke detector is monitored by two air pressure sensors and wherein the air flow passage comprises a perforated pipe leading to the inlet of the smoke detector.

FIG. 2 shows an embodiment in which the enclosed space 4' may be again a toilet or a freight space or a crew resting area. In this embodiment only two air pressure sensors 2 and 3 are used. The sensor 2 is installed in the enclosure 4' while the sensor 3 is installed inside the smoke detector 7. The smoke detector 7 has an air inlet 7A and an air outlet 7B. A smoke gathering inlet pipe 10 provided with holes 10A passes through the enclosure 4' and leads into the air inlet 7A of the smoke detector 7. A smoke outlet pipe 11 is connected to the outlet 7B of the smoke detector 7 and leads into an outlet box 12 with outlet openings 13 and 14. Thus, any smoke that has passed through the smoke detector 7 will flow to the outlet box 12 and out through the outlets 13 and 14 thus providing a further monitoring possibility by viewing the smoke outlets 13 and 14.

The number of holes 10A in the smoke gathering inlet pipe 10 is selected so that a sufficient volume of smoke will be gathered and supplied to the inlet 7A of the smoke detector 7. In this manner the smoke volume that reaches the smoke detector 7 is substantially increased compared to the smoke volume that reaches the smoke detector 7 in the embodiment shown in FIG. 1. Further, the probability that smoke will reach the detector is increased by using a plurality of smoke collecting pipes 10. In any event, the two air pressure sensors 2 and 3 can sense a pressure differential between the smoke detector 7 and the enclosure 4'. The present monitoring system can be used in any enclosed space within an aircraft, for example also in a freight space. As in the first example embodiment, any kind of obstruction in the air flow passage to the smoke detector will be discovered, including the obstruction of the smoke detector inlet by a piece of freight that may have been placed inadvertently in a position where it can close up the air inlet of the smoke detector.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. An apparatus for monitoring the function of a smoke detector in an aircraft, said apparatus comprising a smoke detector, an air flow passage to an air or smoke inlet of said smoke detector, at least two air pressure sensors positioned in such locations relative to said air flow passage that an air pressure differential is detectable in said air flow passage to said smoke detector, a pressure information evaluating unit operatively connected to said at least two air pressure sensors for processing said pressure information to detect an air pressure differential which signifies that a clogging in said air flow passage to said smoke detector prevents said smoke detector from functioning properly, and an indicator for receiving a control signal from said information evaluating unit for indicating that said smoke detector is prevented from functioning properly.

2. The apparatus of claim 1, wherein said two air pressure sensors comprise a first pressure sensor positioned inside said smoke detector and a second pressure sensor positioned outside said smoke detector.

3. The apparatus of claim 2, wherein said second air pressure sensor is positioned upstream of said air or smoke inlet of said smoke detector in said air flow passage.

4. The apparatus of claim 3, further comprising a hood surrounding said air flow passage at least partially upstream of said air or smoke inlet of said smoke detector, said second air pressure sensor being secured to said hood inside said hood.

5. The apparatus of claim 1, further comprising a third air pressure sensor arranged inside an enclosure (4) monitored by said smoke detector.

6. The apparatus of claim 1, comprising an enclosure monitored by said smoke detector, a protective grid positioned in said air flow passage to said smoke detector between said enclosure and said smoke detector, said at least two air pressure sensors comprising a first air pressure sensor positioned upstream of said protective grid and a second air pressure sensor positioned downstream of said protective grid as viewed in an air flow direction toward said smoke detector, whereby said first and second air pressure sensors are positioned for detecting a clogging of said protective grid and thus an impairment of the function of said smoke detector.

7. The apparatus of claim 1, comprising an enclosure monitored by said smoke detector, a protective grid positioned in said air flow passage to said smoke detector between said enclosure and said smoke detector, said at least two air pressure sensors comprising a first air pressure sensor inside said smoke detector and a second air pressure sensor inside said enclosure, whereby said first and second air pressure sensors are positioned for detecting a clogging of said protective grid and thus an impairment of the function of said smoke detector.

8. The apparatus of claim 1, wherein said at least two air pressure sensors comprise a first air pressure sensor positioned downstream of said air or smoke inlet, and a second air pressure sensor positioned upstream of said air or smoke inlet, whereby said air or smoke inlet is positioned between said first and second air pressure sensors for detecting a clogging of said air or smoke inlet of said smoke detector.

9. The apparatus of claim 1, wherein said smoke detector comprises a smoke inlet and a smoke outlet, said air flow passage comprising a first flow pipe leading to said smoke inlet, a second flow pipe leading away from said smoke outlet, said first flow pipe comprising a plurality of holes for smoke to enter into said first flow pipe for reaching said smoke detector.

10. The apparatus of claim 9, further comprising a smoke discharge port and wherein said second flow pipe connects said smoke outlet of said smoke detector to said smoke discharge port for visibly indicating the presence of smoke in an enclosure monitored by said smoke detector in said aircraft.

11. The apparatus of claim 1, wherein said apparatus is installed in a freight space of said aircraft for detecting whether anything has obstructed said air or smoke inlet of said smoke detector.

12. The apparatus of claim 1, wherein said apparatus is installed in a position for monitoring any smoke generation in a toilet of said aircraft.

13. An apparatus for monitoring the function of a smoke detector, said apparatus comprising a smoke inlet for said smoke detector, at least one first air pressure sensor arranged downstream of said smoke inlet, at least one second air pressure sensor arranged upstream of said smoke inlet, as viewed in an air flow direction toward said smoke detector, for detecting an air pressure differential across said smoke inlet of said smoke detector, a pressure information evaluating unit operatively connected to said first and second air pressure sensors for processing a pressure differential information into a control signal signifying a clogging of said smoke inlet of said smoke detector, and an indicator for receiving said control signal for indicating that a smoke detector function is impaired or prevented.

14. The apparatus of claim 13, further comprising a third air pressure sensor so positioned relative to said first and second air pressure sensors that an air pressure differential is detectable between said first and second air pressure sensors and/or between said second and third air pressure sensors for providing information regarding any clogging in an air or smoke flow passage.

15. The apparatus of claim 13, wherein said first air pressure sensor is positioned inside said smoke detector.

* * * * *